United States Patent [19]

Schulz, Jr. et al.

[11] 4,377,279

[45] Mar. 22, 1983

[54] STEEL WIRE FOUNDATION

[75] Inventors: Martin Schulz, Jr., Brenham, Tex.; James E. Bane, Carthage, Mo.

[73] Assignee: Steadley Company, Carthage, Mo.

[21] Appl. No.: 165,976

[22] Filed: Jul. 7, 1980

[51] Int. Cl.[3] ..... F16F 3/02

[52] U.S. Cl. ..... 267/103; 5/247; 5/250; 248/165

[58] Field of Search ..... 267/103, 104, 105, 106, 267/107, 108, 109, 110; 5/250, 249, 247, 246, 262; 248/150, 165, 678, 346; 280/654; 108/56.1; 220/7, 19

[56] References Cited

U.S. PATENT DOCUMENTS

| | | | |
|---|---|---|---|
| 210,148 | 11/1878 | Richardson | 248/165 X |
| 639,628 | 12/1899 | Thomsen et al. | 220/7 |
| 940,234 | 11/1909 | Burleson | 220/7 |
| 982,093 | 1/1911 | Ross | 108/121 |
| 1,052,706 | 2/1913 | Zingg | 5/247 |
| 1,215,292 | 2/1917 | McKay | 220/7 |
| 1,286,607 | 12/1918 | Hammrich | 5/247 |
| 1,528,125 | 3/1925 | Morse | 5/247 |
| 1,918,003 | 7/1933 | Taylor et al. | 108/56.1 |
| 2,430,267 | 11/1947 | Arthur | 108/56.1 |
| 2,462,539 | 2/1949 | Neely et al. | 5/247 X |
| 2,542,904 | 2/1951 | Cobb | 5/247 X |
| 2,832,497 | 4/1958 | Shroyer | 248/346 X |
| 3,546,723 | 12/1970 | Ciampa et al. | 5/247 |
| 4,069,525 | 1/1978 | Valoff | 267/105 X |

FOREIGN PATENT DOCUMENTS

| | | | |
|---|---|---|---|
| 2204020 | 8/1973 | Fed. Rep. of Germany | 267/103 |
| 614133 | 12/1948 | United Kingdom | 267/107 |

*Primary Examiner*—George E. A. Halvosa
*Attorney, Agent, or Firm*—Lee, Smith & Jager

[57] ABSTRACT

A foundation unit which, when assembled, can be collapsed for compact storage and shipping and later can be elevated to a fully expanded state. The foundation unit includes a rectangular, grid wire top bearing structure, a rigid bottom substructure such as a wooden frame, and a series of spaced, parallel rows of substantially flat support members extending between the top bearing structure and the bottom substructure. The support members are hingedly secured to the top bearing structure and bottom substructure to permit reduction of the foundation unit to the collapsed state with the rows of support members lying essentially prone. In the elevated state, the foundation unit includes stabilizers which are oppositely reactive and which prevent relative longitudinal translation between the top and bottom of the foundation unit. Depending on the firmness characteristics required of the foundation unit, the flat support members can assume one of a number of different configurations, offering total stiffness or varying degrees of recoilable compression of the foundation unit.

22 Claims, 13 Drawing Figures

12
14
16
18
20
22
24
26
28
30
32
34
36
38
40
42
44
46

STEEL WIRE FOUNDATION

BACKGROUND OF THE INVENTION

This invention relates to foundation units, and more particularly to a foundation unit which is amenable to storage and shipping in a collapsed state and later elevation to a fully expanded state using the available components of the foundation unit.

Foundation units are found in many forms. The typical "box spring" is composed of a flat wooden bottom frame, a grid wire top surface, and a series of transverse rows and longitudinal columns of coil springs attached between the grid wire and the wooden frame. Top padding and a cover is then applied by the manufacturer as required.

An alternative form for the box spring foundation unit is found in the applicant's U.S. Pat. No. 4,074,372 entitled "Foundation Unit Frame". In that invention, the applicant has disclosed a wooden frame of substantially greater depth, which increases the strength of the foundation unit, reduces the cost of fabrication of the foundation unit, and reduces the depth of the coil springs required.

Other, less expensive foundation units are fabricated using only a wooden or rigid wire frame. A build up of one or more inches of padding material, such as foam rubber, is used to cushion the top of the foundation unit for comfort.

A substantial disadvantage of all prior art foundation units is the requirement that the foundation units be stored or shipped in a fully assembled form. If not, substantial assembling must be done after shipment. In either case, costs are increased due to the large volume occupied by the foundation unit, or due to the large assembly costs after shipping if the unit is shipped in a knocked-down form.

SUMMARY OF THE INVENTION

These disadvantages of the prior art, and others, are overcome by the present invention which provides a foundation unit which is readily amenable to storage and shipment in a collapsed condition, and which can be later reassembled with very little effort and consequently extremely low cost. In addition, since the foundation unit can be maintained in a collapsed state until its use is required, several foundation units can occupy the same space as one fully assembled unit, thereby substantially reducing storage and shipping costs.

The foundation unit is composed of a rigid bottom substructure, such as a wooden frame, and a flat top bearing structure. The top bearing structure and bottom substructure have approximately the same rectangular dimensions, as is typical for foundation units.

A plurality of spaced, parallel rows of substantially flat support members extend between the top bearing structure and bottom substructure. The support members are hingedly secured to the top and bottom structures to permit reduction of the foundation unit to the collapsed state with the support members always attached.

The foundation unit includes stabilizing means positionable in two orientations, one orientation for maintaining the foundation unit in the fully expanded state with the rows of support members generally upright, and a second orientation for permitting reduction of the foundation unit to the collapsed state with the rows of support members essentially prone. Since the support members remain attached in the collapsed state, the top of the foundation unit will overlap one end of the bottom for a slight distance approximately equal to the depth of the support members.

The support members can be of one of two general types. A first type is substantially inflexible and therefore resists spring action of the foundation unit. A second type is flexible in order to permit recoilable compression of the foundation unit. Varying degrees of compression from very firm to soft can be obtained by varying the design of the flexible support members.

Typically, the stabilizing means comprises a series of struts affixed to and extending at an acute angle transversely to the rows of support members. Preferably, one of the struts is positioned in each of the four corners of the foundation unit and, depending on the width of the foundation unit, one or more struts may be utilized intermediate the corners at each end of the foundation unit. The struts at each end of the foundation unit are poised in a direction opposite to that of the struts at the other end of the foundation unit in order to prevent relative longitudinal translation of the top and bottom surfaces of the foundation unit.

When the support members are selected to permit recoilable compression of the foundation unit, the unit must also include means to prevent relative lateral translation between the top and bottom surfaces of the foundation unit as well. Additional struts may be employed, positioned transverse to the longitudinally deployed stabilizing struts, or, in order to increase border firmness, a column of support members may be located at opposite sides of the foundation unit, extending transversely to the rows of the support members. The columns of support members are hingedly secured to the foundation unit as well, in order to permit the foundation unit to be reduced to the collapsed state.

BRIEF DESCRIPTION OF THE DRAWINGS

The invention is described in greater detail below in connection with the drawings, in which.

DESCRIPTION OF THE PREFERRED EMBODIMENTS

Figure 1:
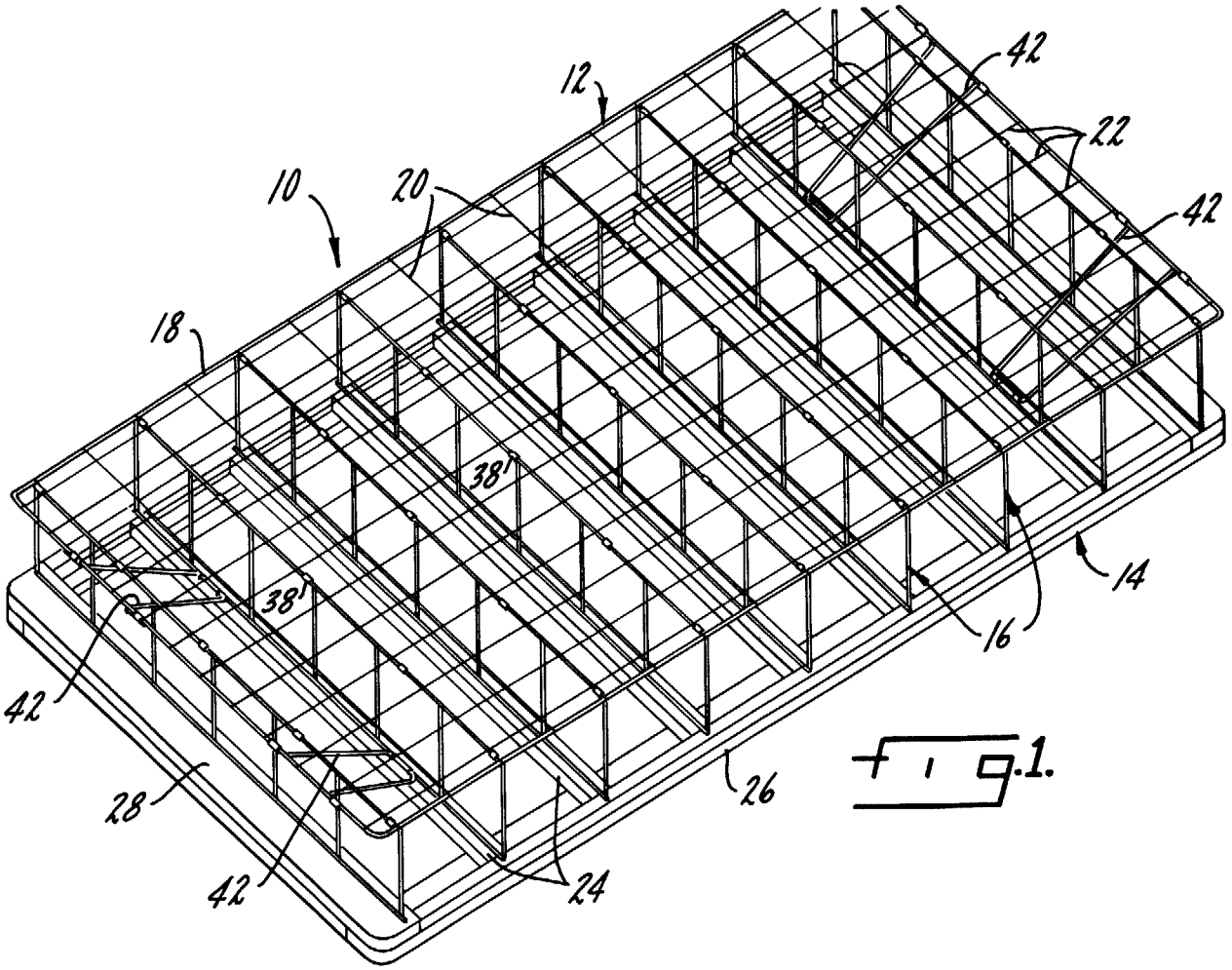
FIG. 1 is a perspective view of a steel wire foundation unit according to the invention.

A steel wire foundation according to the invention, shown generally at 10 in FIG. 1, is comprised of a rectangular, grid wire top bearing structure 12, a rigid bottom substructure 14, such as a wooden frame, and a series of spaced, parallel rows of substantially flat support members 16 extending between the top bearing structure 12 and the bottom substructure 14.

The top bearing structure 12, which may be of any conventional design, is illustrated as a wire network composed of a perimeter border member 18 and a series of parallel transverse rows 20 and longitudinal columns 22 of grid wires extending between opposed edges of the perimeter border member 18. As is conventional, the rows 20 and columns 22 of grid wires are welded to one another at cross points and are also welded to the perimeter border member 18. However, other suitable means of affixing the wires to one another can be used, and is not part of the present invention.

The bottom substructure 14 may also be of a conventional construction. The substructure 14 illustrated comprises a wooden frame having a series of cross slats 24 extending between longitudinal side slats 26. Opposite ends of the longitudinal side slats 26 are capped by end slats 28. The slats are glued, stamped, nailed or otherwise affixed to one another as necessary.

Figures 2, 3, 4:
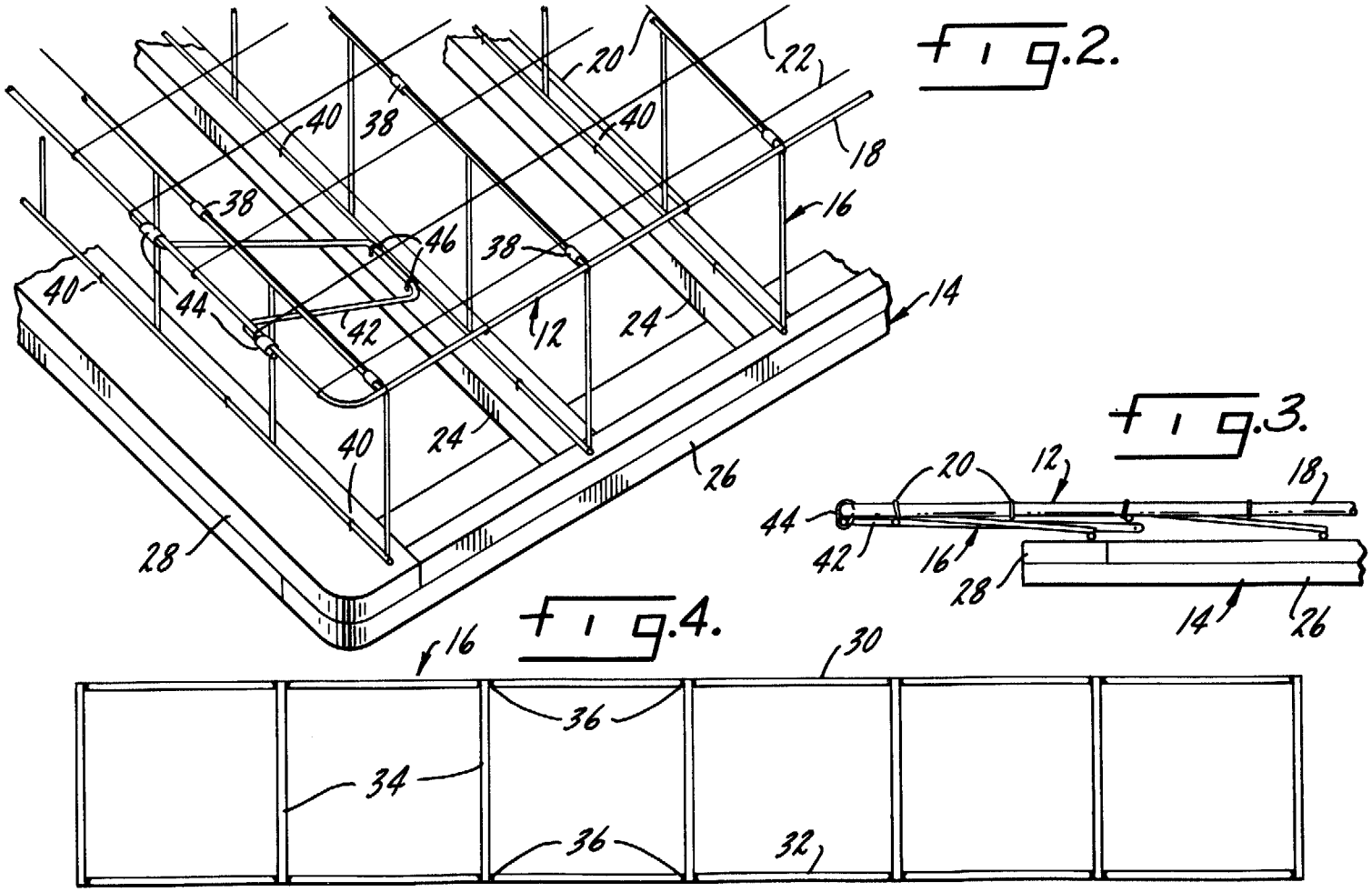
FIG. 2 is an enlarged perspective view of one corner of the foundation unit of FIG. 1.
FIG. 3 is a partial side elevational illustration of the foundation unit in the collapsed state.
FIG. 4 is a front elevational illustration of one embodiment of the support members of the foundation unit.

The support members 16 are attached to the foundation unit between the top bearing structure 12 and the bottom substructure 14. As best illustrated in FIG. 4, the support members 16 illustrated in FIGS. 1 and 2 comprise spaced top and bottom longitudinal members 30 and 32 interconnected by a series of transverse cross members 34. The cross members 34 are rigidly attached to the top and bottom longitudinal members 30 and 32, as by welds 36, to form a rigid, unyielding panel. Again, although welding is preferred, other means of attachment of the cross members 34 to the longitudinal members 30 and 32 can be effected so long as a rigid and secure panel is formed thereby.

As illustrated in FIGS. 1 and 2, and best illustrated in FIG. 2, the support members or panels 16 are spaced in parallel rows laterally across the foundation unit 10 from one end thereof to the other. Each panel is secured to a transverse cross wire 20 of the top bearing structure 12 by means of a plurality of clips 38 securing the wire 20 to the top longitudinal member 30 of the support member 16. The bottoms of the support members 16 are secured to the bottom substructure 14 by means of a plurality of staples 40 which secure the bottom longitudinal member 32 of each support member 16 to a cross slat 24 or end slat 28 of the bottom substructure 14. The clips 38 and staples 40 provide hinged attachment, thus permitting relative longitudinal translation between the top bearing structure 12 and bottom substructure 14 so that, as illustrated in FIG. 3, the foundation unit 10 can be reduced to a collapsed state with the support members 16 lying essentially prone.

To maintain the foundation unit 10 in the upright or expanded state, as illustrated in FIGS. 1 and 2, stabilizing means 42 in the form of struts are employed at each corner of the foundation unit 10, extending at an acute angle between the perimeter border member 18 and one of the cross slats 24 of the bottom substructure 14. The stabilizing means 42 is formed of stiff material, such as a heavy gauge wire, and is affixed to the perimeter border member 18 by a pair of clips 44 and to the cross slats 24 by one or more staples 46.

In the collapsed state, as illustrated in FIG. 3, the stabilizing means 42 are not attached to the cross slats 24, as shown in FIGS. 1 and 2. Rather, the stabilizing means 42 are attached only by the clips 44 to the perimeter border member 18 so that, as illustrated, the stabilizing means 42 can be rotated against the top bearing structure 12 and, when the foundation unit is collapsed, lie essentially prone with the support members 16. Thus, excepting the staples 46 for attachment of the stabilizing means 42 to the cross slats 24, the entire foundation unit 10 can be stored or shipped in the collapsed state (FIG. 3) and then, when use is required, may be raised to the elevated or expanded state (FIGS. 1 and 2) and each of the stabilizing means 42 may be secured to the cross slats 24 with the staples 46.

As illustrated, the struts 42 extend at an acute angle to the top bearing structure 12 and the bottom substructure 14. In addition, the struts 42 at opposite ends of the foundation unit are poised in opposed directions so that collapse of the foundation unit 10 in the longitudinal direction will be prevented. Likewise, the rigid nature of the support members 16 prevents collapse of the foundation unit in the lateral direction.

Figures 5, 6, 7, 8:
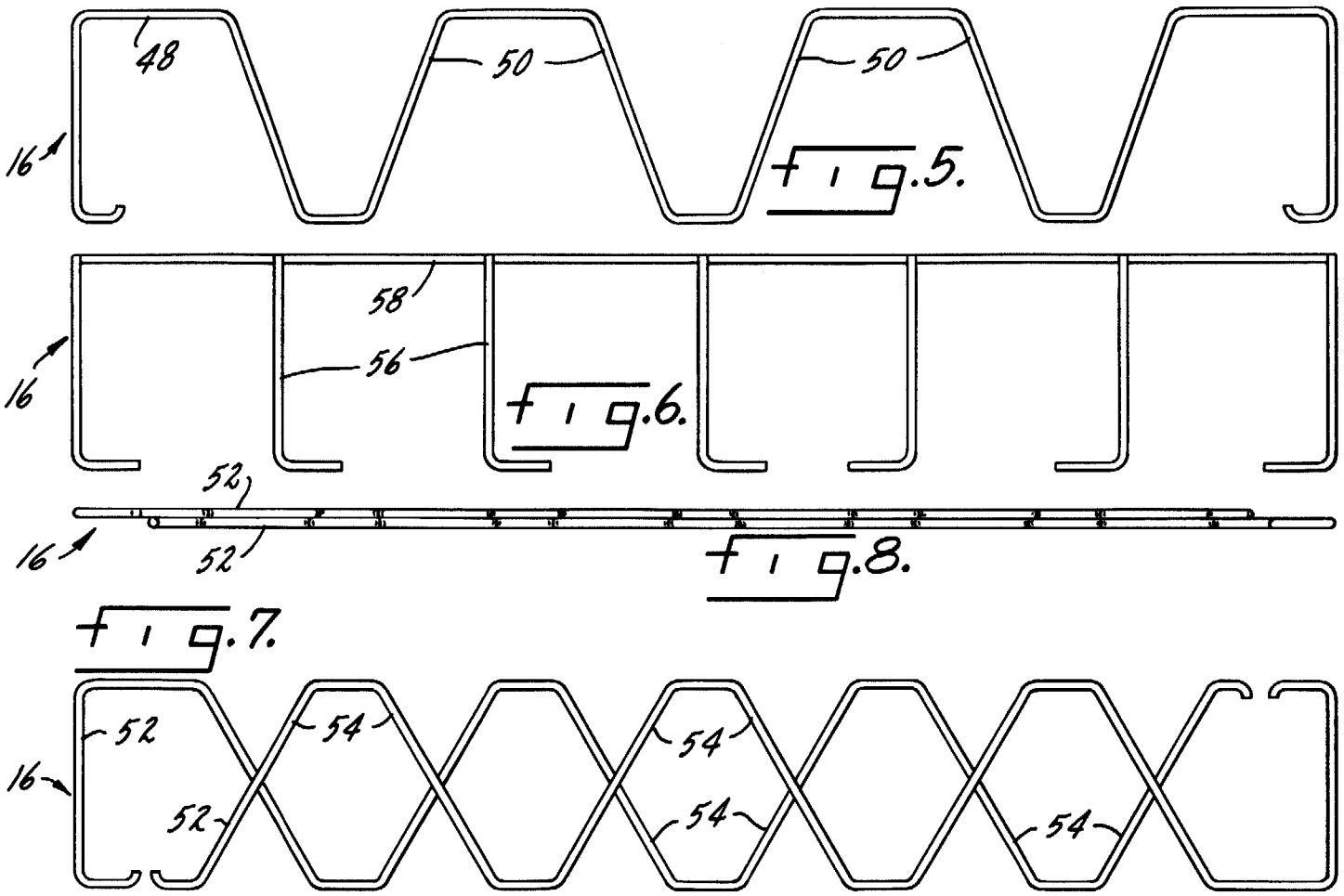
FIG. 5 is a front elevational illustration of another embodiment of the support members of the foundation unit.
FIG. 6 is a front elevational illustration of another embodiment of the support members of the foundation unit.
FIG. 7 is a front elevational illustration of yet another embodiment of the support members of the foundation unit.
FIG. 8 is a top view of the support members of FIG. 7.

Illustrated in FIG. 5 is an alternative embodiment of the support members 16. In this embodiment, the support members 16 are comprised of a rigid wire 48 having a series of spaced, recurved sections 50 which, when forming part of a foundation unit 10, extend between the top bearing structure 12 and the bottom substructure 14.

Similarly, and as illustrated in FIG. 7, a pair of adjoining rigid wires 52 can be employed to form a support member 16, each of the rigid wires 52 having a series of spaced, recurved sections 54 which, when the support member 16 is incorporated into a fabricated foundation unit 10, will extend between the top bearing structure 12 and the bottom substructure 14. As shown in FIGS. 7 and 8, the wires 52 are identical and are oppositely oriented such that each recurved section 54 of one wire overlaps a recurved section of the other wire.

Another embodiment of the support members 16 is illustrated in FIG. 6. Each of the support members of this embodiment is composed of a plurality of "L"-shaped legs 56. A longitudinal member 58 rigidly interconnects the vertical portion of each of the "L"-shaped legs, as illustrated. While the means of interconnecting the leg 56 to the longitudinal member 58 is not illustrated, conventional methods, such as welding or glueing, can be employed so long as the resulting structure is strong and rigid. When installed within a fabricated foundation unit 10, the base of each of the "L"-shaped legs is attached to one of the top bearing structure 12 or the bottom substructure 14, and the longitudinal member 58 is attached to the other of the structures 12 or 14.

Figure 9:
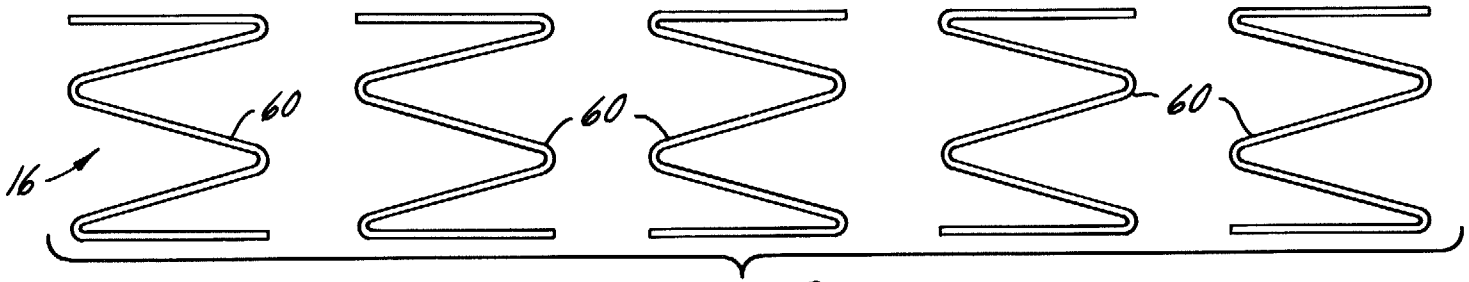
FIG. 9 is a front elevational illustration of one embodiment of a support member which permits recoilable compression of the foundation unit.

If desired, the foundation unit 10 can be fabricated with appropriate support members 16 which are flexible to permit recoilable compression of the foundation unit. One embodiment of such a flexible support member is shown in FIG. 9. In this embodiment, each of the support members 16 comprises a series of spaced, flat springs 60 which lie in a single plane and which, when incorporated within an assembled foundation unit 10 as described above, have one leg attached to the top bearing structure 12 and another leg attached to the bottom substructure 14. The number of the springs 60 depends on the size of the foundation unit. Alternatively, one or more of the springs 60 can be appropriately connected to another of the springs 60 or may be formed of a unitary fabricated wire section. In particular, the applicants have found that forming each panel of the support members 16 from a series of pairs of the springs 60, each pair being formed from a single wire, produces a suitable foundation unit.

Figure 10:
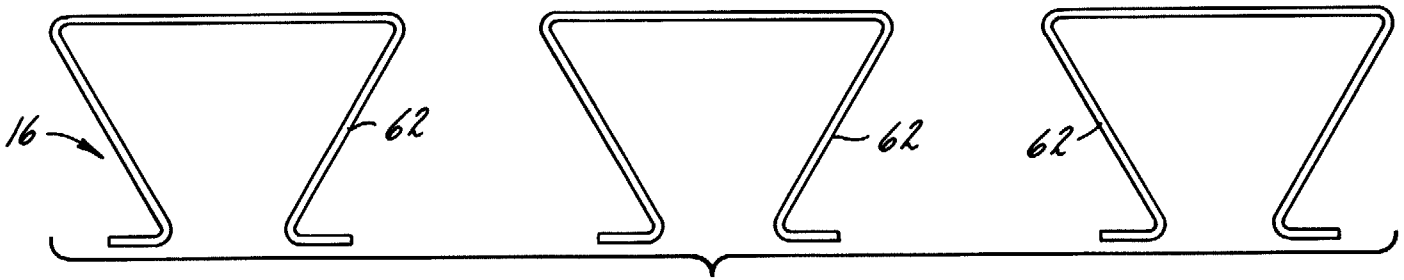
FIG. 10 is a front elevational illustration of another embodiment of a support member which permits recoilable compression of the foundation unit.

The flexible nature of the support members 16 may be of other configurations, as well. As shown in FIG. 10, each support member may be composed of a series of spaced, flat trapezoidal springs 62. Each support member 16 is incorporated within the foundation unit by clips and staples, as described above with regard to FIGS. 1 and 2.

Figure 12:
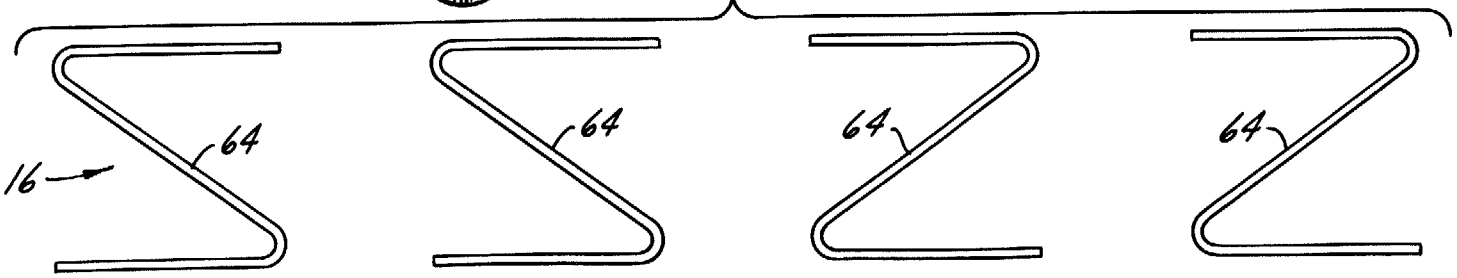
FIG. 12 is a front elevational illustration of another embodiment of the support members, employed in the embodiment of FIG. 11, which permit recoilable compression of the foundation unit.

Another alternative form of a flexible support member 16 is illustrated in FIG. 12. In this embodiment, each of the support members 16 is composed of a series of spaced, flat "Z"-shaped springs 64. The springs may be fabricated and interconnected in exactly the same manner as discussed above in connection with the flat springs 60 of the embodiment of FIG. 9.

In each of the embodiments of FIGS. 9 through 12, the number, spacing and size of the springs 60 through 64 is dictated by the desired firmness and depth of the resulting foundation unit 10. Thus, the number, size and spacing of the springs shown is for illustrative purposes only. In addition, some of the springs of either of these embodiments can be used in connection with springs of any of the other embodiments in order to impart differing flex characteristics to the resulting foundation unit. Thus, the embodiment of the invention utilizing flat, flexible springs is particularly amenable to various configurations and arrangements to permit the greatest flexibility in providing a foundation unit with desired compression characteristics.

Figure 13:
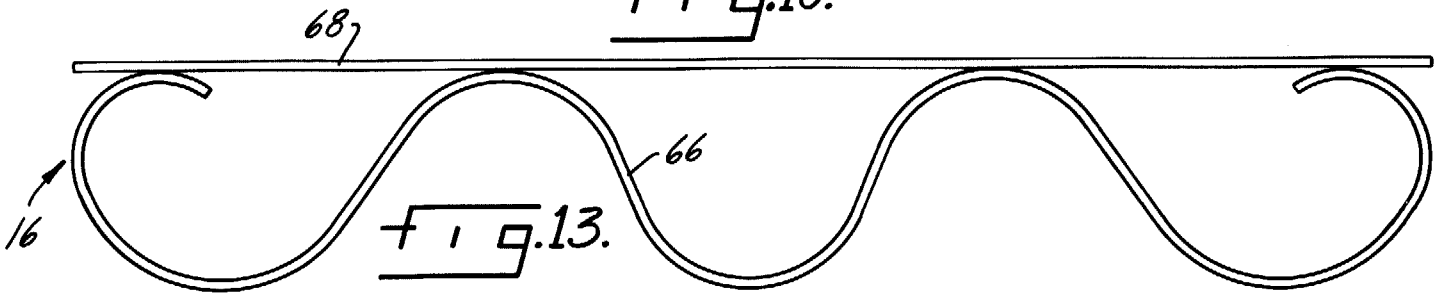
FIG. 13 is a front elevational illustration of yet another embodiment of a support member which permits recoilable compression of the foundation unit.

Illustrated in FIG. 13 is yet another embodiment of the support members 16 which permit recoilable compression of the foundation unit 10. In this embodiment, the support member 16 comprises a serpentine wire 66 which extends between the top bearing structure 12 (FIG. 1) and bottom substructure 14 (FIG. 1) of the foundation unit 10. If desired, a longitudinal wire 68 may be employed to interconnect adjacent hills of the serpentine wire 66. The two wires 66 and 68 are suitably attached, such as by welding or other bonding.

Figure 11:
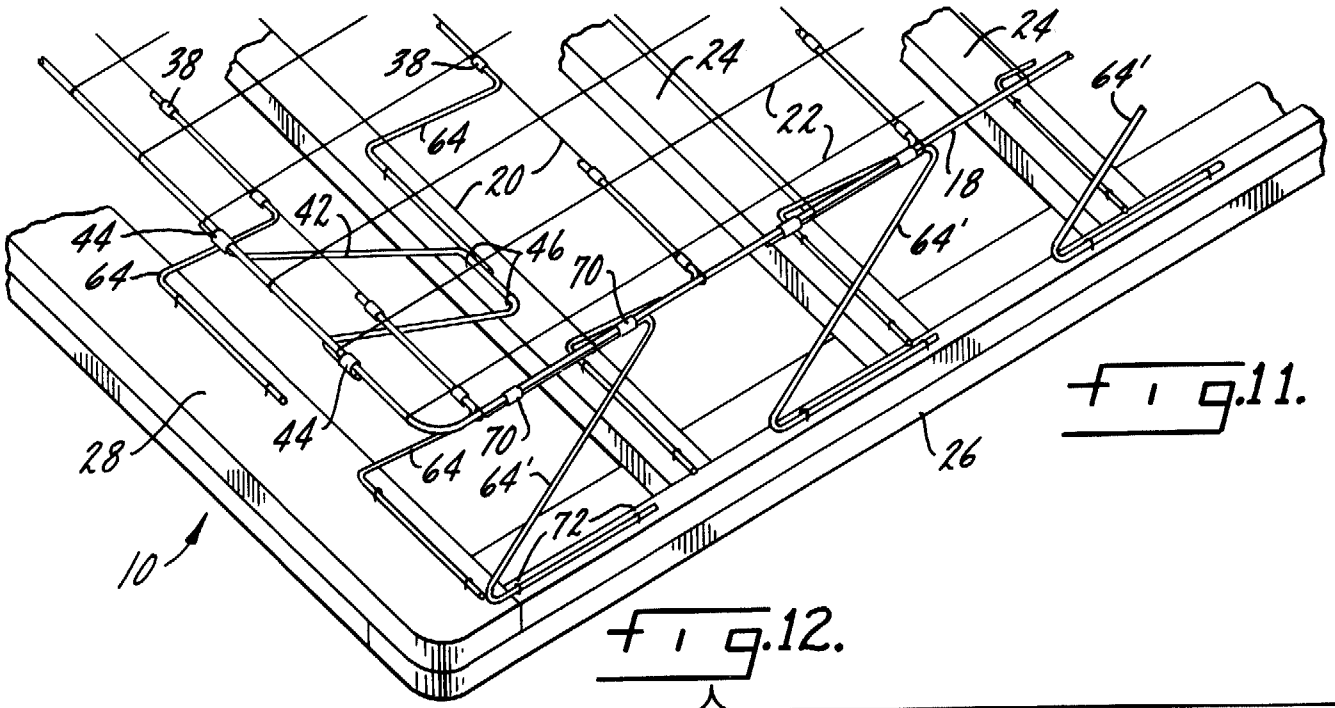
FIG. 11 is an enlarged perspective view of one corner of the foundation unit employing support members permitting recoilable compression of the foundation unit.

Shown in FIG. 11 is a perspective illustration of one corner of a foundation unit 10 according to the invention, much the same as shown in FIG. 2, but employing as the support members 16 a series of the "Z"-shaped springs 64 depicted in FIG. 12. All other components of the foundation unit are as described with regard to FIG. 2.

In order to increase the strength of the foundation unit in the lateral direction and also provide additional firmness of the foundation unit along its border, the foundation unit may also include a column of support members, in this embodiment being "Z"-shaped springs 64', attached between the perimeter border 18 and the longitudinal side slats 26. A column of the "Z"-shaped springs 64' is employed on each longitudinal side of the foundation unit 10.

In order to permit reduction of the foundation unit 10 of FIG. 11 to the collapsed state, not only must the struts 42 be free from the cross slats 24, but also the "Z"-shaped springs 64' must be free from either the top bearing structure 12 or the bottom substructure 14. Thus, either clips 70, which affix the springs 64' to the perimeter border member 18, or staples 72, which affix the spring 64' to the longitudinal side slats 26, are omitted until use of the foundation unit is desired. Each of the springs 64' may therefore be laid flat against either the top bearing structure 12 or the bottom substructure 14 to permit reduction of the foundation unit to the collapsed state. When the foundation unit is assembled in the upright or expanded state, the springs 64 and 64' are brought to a vertical orientation and attached as shown in FIG. 11.

Rather than employing a series of springs 64' in a longitudinal column as shown in FIG. 11, other means of imparting greater stability to the foundation unit can be employed. For example, a series of struts 42 can be oriented transversely to the struts 42 shown in FIG. 11 in order to prevent lateral shifting between the top bearing structure 12 and the bottom substructure 14, although border firmness will be some what compromised. In addition, other of the flexible support members of FIGS. 9, 10 and 13 can be employed in place of the springs 64'.

Various changes can be made to the invention without departing from the spirit thereof or scope of the following claims.

What is claimed is:

1. In a foundation unit for support of human beings, said foundation unit being of determined depth and having a flat top bearing structure which is generally rectangular in shape and which has opposite longitudinal end edges and opposite lateral side edges, said foundation unit further having a bottom substructure, and support means intermediate the top bearing structure and bottom substructure for maintaining the determined depth, the improvement comprising a collapsible foundation unit in which a. said support means comprises a plurality of spaced, parallel rows of support members, each row of support members extending substantially between the opposite lateral side edges of the top bearing structure, and each row of support members lying essentially in a single plane, with a plurality of said rows of support members being located intermediate said end edges, b. means hingidly securing said rows of support members to said top bearing structure and said bottom substructure to permit collapse of the foundation unit about said rows of support members, and c. stabilizing means attached to the foundation unit and positionable in one orientation for maintaining the foundation unit in an expanded state and positionable in a second orientation to permit collapse of the foundation unit, said stabilizing means comprising a plurality of elongated struts extending at an incline between said top bearing member and said bottom substructure when the foundation unit is in the expanded state, at least one of said struts being poised in a direction opposite from at least one other of said struts to prevent collapse of the foundation unit, said struts being rigid in their longitudinal direction and being situated to extend between a said intermediate row of support members and an adjacent row of support members proximate to at least one end edge of said foundation unit.

2. The foundation unit according to claim 1 in which said struts are affixed to and extend at an acute angle transversely to said support members.

3. The foundation unit according to claim 1 in which said struts are hingedly secured to said top bearing structure.

4. The foundation unit according to claim 1 in which said struts are situated at opposite ends of the foundation unit.

5. The foundation unit according to claim 4 in which said top bearing structure includes a perimeter border member and said struts are hingedly secured to said perimeter border member.

6. A foundation unit for support of human beings comprising:

a. a rectangular top bearing structure having opposite longitudinal end edges and opposite lateral side edges, b. a rigid bottom substructure having approximately the same rectangular dimension as the top bearing structure, c. a plurality of spaced, parallel rows of substantially flat support members extending between the top bearing structure and the bottom structure, with a plurality of said rows of support members being located intermediate said end edges, d. means hingedly securing said rows of support members to said top bearing structure and bottom substructure, and e. stabilizing means comprising a plurality of elongated struts positionable in two orientations, one orientation extending at an incline between said top bearing structure and said bottom substructure for maintaining the foundation unit in an expanded state with the rows of support members generally upright, at least one of said struts being poised in a direction opposite from at least one other of said struts to prevent collapse of the foundation unit, and another orientation for permitting reduction of the foundation unit to a collapsed state with the rows of support members essentially prone, said struts being rigid in their longitudinal direction and being situation to extend between a said intermediate row of support members and an adjacent row of support members proximate to at least one end edge of said foundation unit.

7. The foundation unit according to claim 6 in which said support members are substantially inflexible.

8. The foundation unit according to claim 7 in which said support members comprise spaced top and bottom longitudinal members and a plurality of spaced, parallel transverse crossmembers rigidly attached to said top and bottom longitudinal members, thereby forming a plurality of spaced, parallel panels, said top longitudinal members being secured to said top bearing structure and said bottom longitudinal members being secured to said bottom substructure.

9. The foundation unit according to claim 8 in which said panels extend between opposed edges of the foundation unit.

10. The foundation unit according to claim 7 in which said support members comprise a plurality of "L"-shaped legs and a longitudinal member rigidly interconnecting the vertical portion of each "L"-shaped leg.

11. The foundation unit according to claim 7 in which said support members comprise a rigid wire having a series of spaced recurved sections extending between the top bearing structure and bottom substructure.

12. The foundation unit according to claim 7 in which said support members comprise a pair of adjoining rigid wires, each wire having a series of spaced recurved sections extending between the top bearing structures and bottom substructure.

13. The foundation unit according to claim 12 in which said wires are identical and are oppositely oriented such that each recurved section of one wire overlaps a recurved section of the other wire.

14. The foundation unit according to claim 6 in which said support members are flexible to permit recoilable compression of the foundation unit.

15. The foundation unit according to claim 14 in which said support members comprise a series of spaced, flat springs each having one leg attached to the top bearing structure and another leg attached to the bottom substructure.

16. The foundation unit according to claim 15 in which said springs are "Z"-shaped.

17. The foundation unit according to claim 15 in which said stabilizing means is positioned to resist relative longitudinal translation between said top bearing structure and bottom substructure, and further including additional stabilizing means positioned to resist relative lateral translation between said top bearing structure and said bottom substructure.

18. The foundation unit according to claim 14 in which said support members comprise a series of spaced, flat, trapezoidal springs.

19. The foundation unit according to claim 14 in which said support members comprise a serpentine wire extending transversely between the top bearing structure and bottom substructure.

20. The foundation unit according to claim 14 further including at least one column of said support members extending transversely to said rows of support members and hingedly secured to said foundation unit.

21. The foundation unit according to claim 20 in which one said column of support members is attached to the outer periphery of said top bearing structure.

22. The foundation unit according to claim 6 in which each of said top bearing structure and bottom substructure includes a plurality of transverse crossmembers, and said support members are secured to said crossmembers.

* * * * *